US007991612B2

(12) United States Patent
Chen et al.

(10) Patent No.: US 7,991,612 B2
(45) Date of Patent: Aug. 2, 2011

(54) LOW COMPLEXITY NO DELAY RECONSTRUCTION OF MISSING PACKETS FOR LPC DECODER

(75) Inventors: Eric Hsuming Chen, Saratoga, CA (US); Ke Wu, San Jose, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 944 days.

(21) Appl. No.: 11/927,512

(22) Filed: Oct. 29, 2007

(65) Prior Publication Data

US 2008/0114592 A1 May 15, 2008

Related U.S. Application Data

(60) Provisional application No. 60/865,111, filed on Nov. 9, 2006.

(51) Int. Cl.
*G10L 19/04* (2006.01)

(52) U.S. Cl. ..... 704/219

(58) Field of Classification Search ..... 704/219
See application file for complete search history.

(56) References Cited

U.S. PATENT DOCUMENTS

| | | | | |
|---|---|---|---|---|
| 6,744,757 | B1 * | 6/2004 | Anandakumar et al. | 370/352 |
| 6,801,499 | B1 * | 10/2004 | Anandakumar et al. | 370/229 |
| 6,801,532 | B1 * | 10/2004 | Anandakumar et al. | 370/394 |
| 7,574,351 | B2 * | 8/2009 | Anandakumar et al. | 704/201 |
| 7,653,045 | B2 * | 1/2010 | Anandakumar et al. | 370/352 |
| 7,668,712 | B2 * | 2/2010 | Wang et al. | 704/219 |
| 7,822,021 | B2 * | 10/2010 | Anandakumar et al. | 370/352 |

* cited by examiner

*Primary Examiner* — Susan McFadden
(74) *Attorney, Agent, or Firm* — Joshua D. Isenberg JDI Patent

(57) ABSTRACT

Lost frame reconstruction is described. A previous good or reconstructed frame may be analyzed to determine a category for the lost frame. A percentage $P_i$ may be associated with the determined category of the lost frame. A top $P_i$ percent magnitude samples may be zeroed out in an excitation of the previous good or reconstructed frame to produce a reconstruction excitation. The reconstruction excitation may be applied to one or more linear prediction coefficients for the previous good or reconstructed frame to generate a reconstructed frame.

19 Claims, 3 Drawing Sheets voiced original voiced missing frame unvoiced original unvoiced missing frame voiced unvoiced high-to-low energy transition low-to-high energy transition

LOW COMPLEXITY NO DELAY RECONSTRUCTION OF MISSING PACKETS FOR LPC DECODER

PRIORITY CLAIM

This application claims the benefit of priority co-pending U.S. provisional application No. 60/865,111, to Eric H. Chen et al, entitled "LOW COMPLEXITY NO DELAY RECONSTRUCTION OF MISSING PACKETS FOR LPC DECODER" filed Nov. 9, 2006, the entire disclosures of which are incorporated herein by reference.

FIELD OF THE INVENTION

Embodiments of the present invention are directed transmission of signals over a packetized network and more particularly to reconstruction of lost frames.

BACKGROUND OF THE INVENTION

In digitized speech transmission through a packetized network, one often needs to consider how to handle missing packets that may be lost due to erroneous deletion or overloaded network. Missing packets may cause discontinuities in the synthesized speech and under-run of the output speech buffer, which, in turn may cause a popping noise and/or distorted sound.

It is within this context that embodiments of the present invention arise.

BRIEF DESCRIPTION OF THE DRAWINGS

The teachings of the present invention can be readily understood by considering the following detailed description in conjunction with the accompanying drawings, in which.

DESCRIPTION OF THE SPECIFIC EMBODIMENTS

Although the following detailed description contains many specific details for the purposes of illustration, anyone of ordinary skill in the art will appreciate that many variations and alterations to the following details are within the scope of the invention. Accordingly, examples of embodiments of the invention described below are set forth without any loss of generality to, and without imposing limitations upon, the claimed invention.

II. Summary

A method of low complexity and no delay reconstruction of missing packets is proposed for Linear Predictive Coding (LPC) based Speech decoder. An algorithm for implementing such a method may be adaptive to the number of consecutive lost frames. Embodiments of the method use mathematical extrapolation based on previous good or reconstructed frames to re-generate the base of the lost frames. The adaptation of different schemes in generating the missing frame may be based on the characteristics of the speech status at lost condition. This method differentiates from the prior art in a number of ways. First, this method can rely solely on a previous frame or frames, instead of both previous and future frames as in most prior art. Such implementations introduce no delay to the system. Second, by adapting the incoming order of the lost frame and the characteristics of LPC coder, the proposed method may reconstruct the lost frame(s) in a very low complexity, thus offering continuity and significant improvement of the synthesis speech quality when packet losses are encountered in the network.

III. Problem Analysis

Figure 1A:
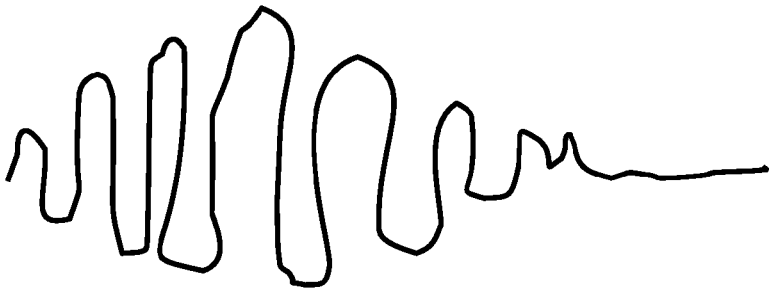
FIGS. 1A-1D depict several voice signal waveforms illustrating the difference between voiced original signals and synthesized voice signals having a missing frame.
Figure 1B:
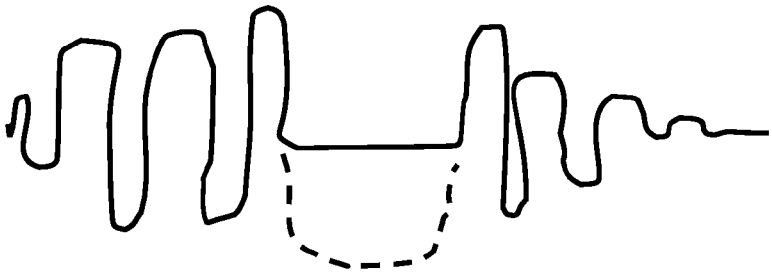
Figure 1C:
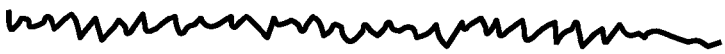
Figure 1D:
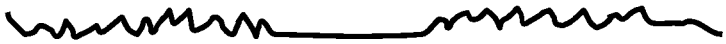
Figure 2A:
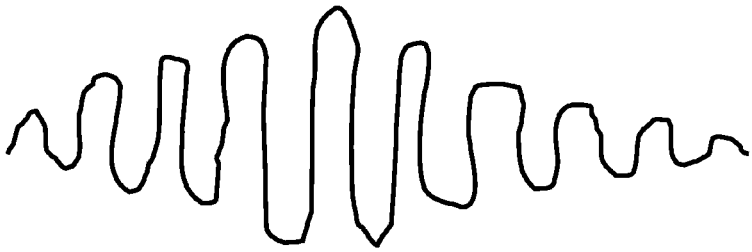
FIGS. 2A-2D depict portions of voice signal waveforms illustrating the difference between voiced, unvoiced, high-to-low and low-to-high categories of signals.
Figure 2B:
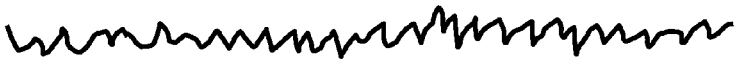
Figure 2C:
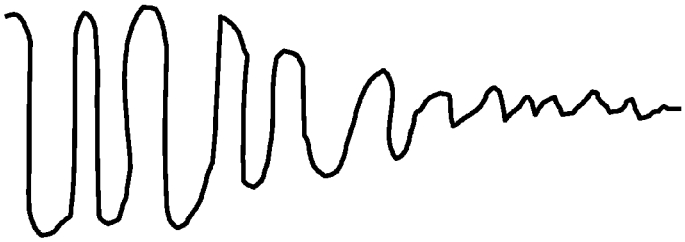
Figure 2D:
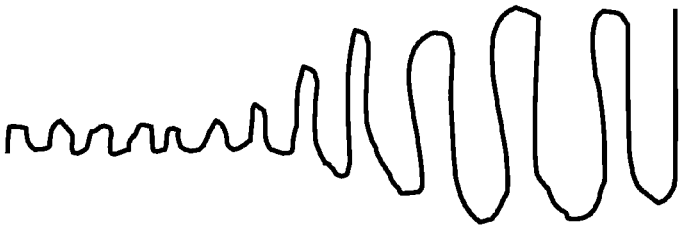

Missing packets in real-time speech communication system may cause discontinuities or gaps in synthesized speech. If an audio frame is dropped during a relatively silent period, the ill effect is mostly likely unnoticeable by human ear. However, if the dropped frame is a voice frame, it may cause significant degradation of speech quality since a sharp edge in the resulting waveform may be created when an output audio buffer is exhausted due to deficiency of speech packets. FIGS. 1A-1B illustrate the difference between a voiced original signal and a synthesized voice signal having a missing frame. Similarly, FIGS. 1C-1D illustrate the difference between an unvoiced original signal and a synthesized unvoiced signal having a missing frame. Depending on the location or frequency of dropped frames, a popping or clicking sound or noisy speech may be generated. Therefore, reconstruction of the missing frame is highly desirable. However, the nature of reconstruction is also somewhat dependent on the type of sound in the frame that has been dropped. For example, the transition may be much more abrupt when the dropped frame occurs during a voice signal that during an unvoiced signal.

Linear predictive coding (LPC) is a tool used mostly in audio signal processing and speech processing for representing the spectral envelope of a digital signal of speech in compressed form, using the information of a linear predictive model. A speech encoder may receive an analog signal from a transducer such as a microphone. The analog signal may be converted to a digital signal. Alternatively, the encoder may generate the digital signal may be based on a software model of the speech to be synthesized. The digital signal may be encoded to compress it for storage and/or transmission. The encoding process may involve breaking down the signal in the time domain into a series of frames. Frames are sometimes referred to herein as packets, particularly in the context of data transmitted over a network. Each frame may last a few milliseconds, e.g., 10 to 15 milliseconds. Each frame may further divided up into a number of sub-frames, e.g., 4 to 10 sub-frames. Within each sub-frame may be several individual samples of the analog signal. There may be on the order of a hundred samples in a frame, e.g., 160 to 240 samples. To aid in compression, the digital signal may be encoded as an excitation value for each sample and a set of linear prediction coefficients. Each sub-frame may have its own set of linear prediction coefficients, e.g., about 4 to 10 LPC coefficients per sub-frame. The LPC coefficients are related to the peaks in the frequency domain signal for that particular sub-frame. The LPC coefficients may mathematically model or characterize a source of sound such as a vocal tract. The excitation values may model the sound generating impulse(s) applied to the sound source.

By way of example, some audio coding schemes, e.g., Code Excited Linear Prediction (CELP) and its variants, utilize Analysis-by-Synthesis (AbS), which means that the encoding (analysis) is performed by perceptually optimizing the decoded (synthesis) signal in a closed loop.

In order to achieve real-time encoding using limited computing resources, a CELP search for an optimum combination may be broken down into smaller, more manageable, sequential searches using a simple perceptual weighting function. Typically, the encoding may be performed in the following order:

LPC coefficients may be computed and quantized, e.g., as Line Spectral Pairs (LSPs). An adaptive (pitch) codebook is searched and its contribution removed. A fixed (innovation) codebook may then be searched and its contribution to the LPC coefficients may be determined. A decoder may produce the excitation from the encoded digital signal by summing contributions from the adaptive codebook and fixed codebook:

$$e[n]=e_a[n]+e_f[n]$$

where $e_a[n]$ is the adaptive (pitch) codebook contribution and $e_f[n]$ is the fixed (innovation) codebook contribution. The codebooks may be implemented in software, hardware or firmware.

In CELP decoding, the filter that shapes the excitation has an all-pole (infinite impulse-response) model of the form 1/A(z), where A(z) is called the prediction filter and is obtained using linear prediction (e.g., the Levinson-Durbin algorithm). An all-pole filter is used because it is a good representation of the human vocal tract and because it is easy to compute.

The process of decoding the compressed digital signal involves applying the excitation to the LPC coefficients to produce a digital signal representing the synthesized speech. This typically involves taking a weighted average that uses weights based on the LPC coefficients.

Synthesis of a final signal for conversion to analog and presentation by a transducer, e.g., a speaker, may involve a smoothing step. For example, a synthesized frame may be generated from the last half of one frame and the first half of the next frame. The LPC coefficients applied to each subframe of the synthesized frame may be determined based on weighted averages of the sub-frames that make up the synthesized frame. Generally, the LPC coefficients for a particular sub-frame are given greater weight. Weights LPC coefficients for the other sub-frames may decrease with distance in time from the particular sub-frame. It is noted that the same type of smoothing process may be applied by the encoder before the compressed digital signal is stored or transmitted.

IV. Algorithm Design

Figure 3:
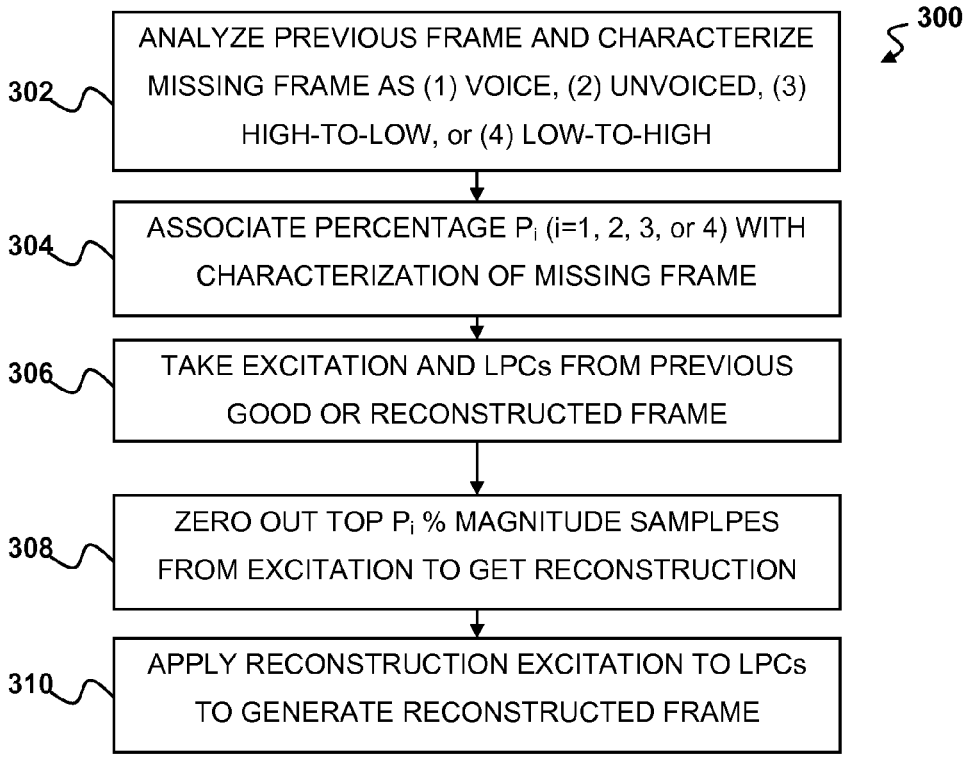
FIG. 3 is a flow diagram illustrating an example of a method for reconstruction of lost audio frames according to an embodiment of the present invention.

According to an embodiment of the invention, a method 300 for lost frame reconstruction may proceed as illustrated in FIG. 3. The method 300 may be thought of as comprising two major stages: an analysis and categorization stage, and a frame reconstruction stage. The latter stage mainly manipulates excitation during the speech synthesis process.

In the analysis and categorization stage, one or more previous good frames are taken into account to categorize the current speech status as indicated at 302. According to one embodiment, among others, there may be four mutually exclusive categories of frames; namely, voice, unvoiced, high-to-low energy transition, low-to-high energy transition. Examples of waveforms corresponding to each of these categories are illustrated in FIGS. 2A-2D. Determining the category for the waveform is largely a matter of determining the behavior of the signal energy magnitude of the waveform as a function of time during the frame. For example if the energy magnitude is relatively large and constant, the frame may be categorized as a voice frame. If the energy magnitude is relatively small and constant, the frame may be categorized as an unvoiced frame. If the energy magnitude decreases with time, the frame may be categorized as a high-to-low transition frame. If the energy magnitude increases with time, the frame may be categorized as a low-to-high transition frame. The missing or lost frame may be given the same classification as the previous good frame or previous reconstructed frame.

Once the previous good or reconstructed frame has been categorized a percentage factor may be associated with the lost frame based on the determined categorization. By way of example, and without loss of generality, percentage factors, $P_1$, $P_2$, $P_3$, and $P_4$, may be respectively assigned to the voice, unvoiced, high-to-low and low-to-high categories, as indicated at 304. By way of example, and without loss of generality, the percentage may increase when the subscript increases, which can be expressed mathematically as: $P_1<(P_2, P_3)<P_4$. Note that in this particular example $P_2$ may be greater than $P_3$ or vice versa. The percentage factors may be adaptively generated by a formula that takes into account sound characteristic statistics from previous frames, the incoming order of the missing packets and also subjective based on processed speech statistics. The formula used to generate the percentages may be adjusted based on a listener's experience with sound quality of speech synthesized with lost frame reconstruction using the algorithm.

Once a percentage has been associated with the lost frame, the frame reconstruction stage may proceed. By way of example, raw excitation samples may be generated based on the parameters of the last received frame (or last reconstructed frame) as indicated at 306. Based on the categorization determined for the lost frame, the raw excitation signal from the previous good frame or recovered frame may be manipulated to produce a reconstruction excitation signal as indicated at 308. For example, if the lost frame is classified as "voiced", $P_1$ percent of the raw excitation samples with highest magnitudes are zeroed out. By way of example, if there are 100 samples in a frame and $P_1$=10%, the first though tenth highest magnitude excitation samples are set equal to zero (or some other suitable low value magnitude). Alternatively, if the classification is "unvoiced", $P_2$ percent of the raw excitation samples with highest magnitudes are zeroed out. Similarly, if the lost frame is classified as "high-to-low energy transition", $P_3$ percent of the raw excitation samples with highest magnitudes are zeroed out. Furthermore, if the lost frame is classified as "low-to-high energy transition", $P_4$ percent of the raw excitation samples with highest magnitudes are zeroed out.

The LPC coefficients for the previous received good frame (or previous reconstructed frame) are then applied to a LPC filter used to generate the reconstructed frame as indicated at 310. The reconstructed frame may be generated by applying the reconstruction excitation to the LPC filter. It is noted that samples in the reconstruction excitation that were set equal to zero during the reconstruction at 308 do not necessarily lead to zero-valued samples in the reconstructed frame due to the weighted averaging used to generate the reconstructed frame. If an adaptive codebook is being used, the adaptive codebook may be updated with the new excitation.

If two or more frames in a row were dropped the, the earliest dropped frame may be reconstructed from the immediately preceding good frame, as described above. The next dropped frame may then be reconstructed from the previous reconstructed frame using the algorithm described above. The percentages $P_1$, $P_2$, $P_3$, $P_4$ may be adaptively adjusted to avoid over-attenuating subsequent reconstructed frames. The percentages may decrease with each frame that must be recovered from a reconstructed frame.

It is noted that the algorithm may be implemented to recover lost frames on either the encoder side or the decoder side. In particular, the algorithm may be applied to audio frames lost after generation of a plurality of audio frames on an encoder side or to lost audio frames after receiving a plurality of audio frames on the decoder side.

The simplicity of the above algorithm demands a relatively small amount of computation power when implemented. On the other hand, since the reconstruction of a dropped frame depends only on previous frame, the algorithm does not introduce a delay associated with waiting for a future frame. Such extra delay might otherwise exaggerate the reduced quality associated with frame reconstruction since some amount of fidelity may be surrendered in the packet lost condition. Since the orientation and design of current linear prediction coefficient (LPC) decoders are relatively low in complexity and also low in decoder-introduced delay, the proposed algorithm reconstructs the missing speech frame with minimum effort and no extra delay introduced.

Figure 4:
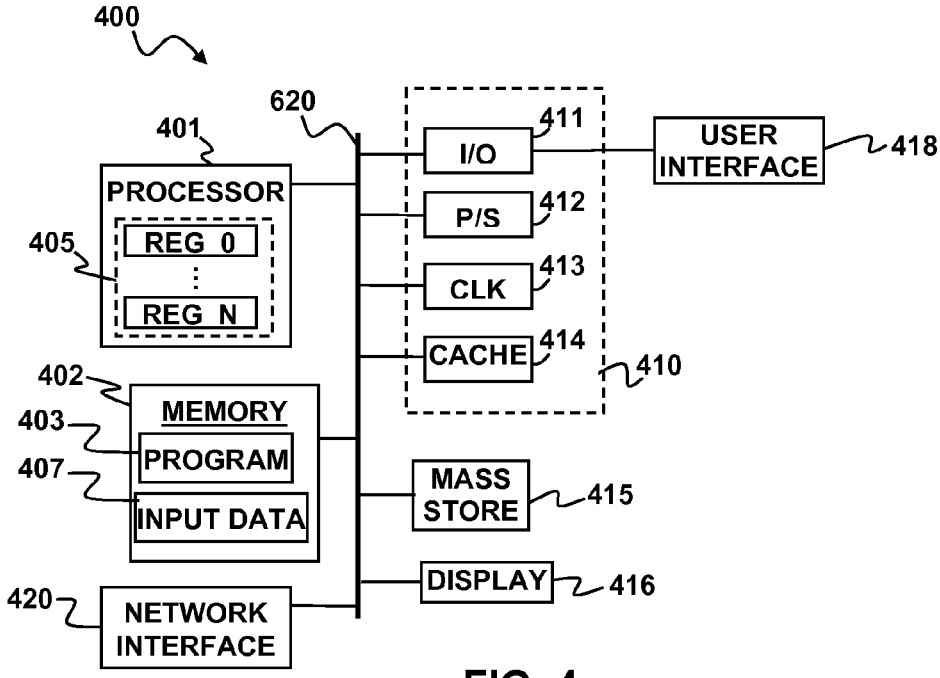
FIG. 4 is a schematic diagram of an apparatus for reconstruction of lost frames according to an embodiment of the present invention.

The frame reconstruction algorithm may be implemented in software or hardware or a combination of both. By way of example, FIG. 4 depicts a computer apparatus 400 for implementing such an algorithm. The apparatus 400 may include a processor module 401 and a memory 402. The processor module 401 may include a single processor or multiple processors. As an example of a single processor, the processor module 401 may include a Pentium microprocessor from Intel or similar Intel-compatible microprocessor. As an example of a multiple processor module, the processor module 401 may include a cell processor.

The memory 402 may be in the form of an integrated circuit, e.g., RAM, DRAM, ROM, and the like). The memory 402 may also be a main memory or a local store of a synergistic processor element of a cell processor. A computer program 403 that includes the frame reconstruction algorithm described above may be stored in the memory 402 in the form of processor readable instructions that can be executed on the processor module 401. The processor module 401 may include one or more registers 405 into which instructions from the program 403 and data 407, such as compressed audio signal input data may be loaded. The instructions of the program 403 may include the steps of the method of lost frame reconstruction, e.g., as described above with respect to FIG. 3. The program 403 may be written in any suitable processor readable language, e.g., C, C++, JAVA, Assembly, MATLAB, FORTRAN and a number of other languages. The apparatus may also include well-known support functions 410, such as input/output (I/O) elements 411, power supplies (P/S) 412, a clock (CLK) 413 and cache 414. The apparatus 400 may optionally include a mass storage device 415 such as a disk drive, CD-ROM drive, tape drive, or the like to store programs and/or data. The apparatus 400 may also optionally include a display unit 416 and user interface unit to facilitate interaction between the device and a user. The display unit 416 may be in the form of a cathode ray tube (CRT) or flat panel screen that displays text, numerals, graphical symbols or images. The display unit 416 may also include a speaker or other audio transducer that produces audible sounds. The user interface 418 may include a keyboard, mouse, joystick, light pen, microphone, or other device that may be used in conjunction with a graphical user interface (GUI). The apparatus 400 may also include a network interface 420 to enable the device to communicate with other devices over a network, such as the internet. These components may be implemented in hardware, software or firmware or some combination of two or more of these.

V. Results

An algorithm in accordance with embodiments of the present invention has been implemented in several applications. Clear improvements of speech quality in the simulated packet lost network have been observed. At a packet loss rate of 10%, speech quality degradation is merely noticeable. When the loss rate increases to 20%, a comfortable speech is preserved without major artifacts, such as noise or popping/clicking sounds. By contrast, when the same speech passes through a simulated network without this algorithm, the speech is hardly tolerable at this loss rate.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "A" or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A method for reconstruction of lost frames, comprising:

a) analyzing a previous good or reconstructed frame to determine a category for the lost frame;

b) associating a percentage $P_i$ with the determined category for the lost frame;

c) zeroing out a top $P_i$ percent magnitude samples in an excitation of the previous good or reconstructed frame to produce a reconstruction excitation; and d) applying the reconstruction excitation to one or more linear prediction coefficients for the previous good or reconstructed frame to generate a reconstructed frame.

2. The method of claim 1 wherein the lost frame and previous good or reconstructed frame are audio frames.

3. The method of claim 2 wherein a) includes determining whether the lost frame was a voice frame, an unvoiced frame, a high-to-low energy transition frame or a low-to-high energy transition frame.

4. The method of claim 3 wherein:

$P_i=P_1$, if the lost frame is a voice frame;

$P_i=P_2$, if the lost frame is an unvoiced frame, $P_i=P_3$, if the lost frame is a high-to-low energy transition frame, $P_i=P_4$, if the lost frame is a high-to-low energy transition frame, wherein $P_1<P_2<P_3<P_4$ or $P_1<P_3<P_2<P_4$.

5. The method of claim 1, further comprising updating an adaptive codebook with the reconstruction excitation.

6. The method of claim 1 wherein a) includes determining a behavior of a signal energy magnitude as a function of time during the previous good or reconstructed frame.

7. The method of claim 6 wherein a) includes categorizing the previous good or reconstructed frame as a voice frame if the energy magnitude is determined to be relatively large and constant.

8. The method of claim 6 wherein a) includes categorizing the previous good or reconstructed frame as an unvoiced frame if the energy magnitude is determined to be relatively small and constant.

9. The method of claim 6 wherein a) includes categorizing the previous good or reconstructed frame as a high-to-low transition frame if the energy magnitude is determined to decrease with time.

10. The method of claim 6 wherein a) includes categorizing the previous good or reconstructed frame as a low-to-high transition frame if the energy magnitude is determined to increase with time.

11. The method of claim 1, wherein a) includes assigning a category to the lost frame that is the same as a category of the previous good or reconstructed frame.

12. The method of claim 1, further comprising adjusting a formula used to generate the percentage $P_i$ based on a listener's experience with sound quality of speech synthesized with the reconstructed frame.

13. The method of claim 1, wherein, if two or more consecutive frames are lost frames, the lost frames are reconstructed by performing a) through d) for an earliest of the two or more consecutive frames to generate a first reconstructed frame and repeating a) through d) for a subsequent on of the two or more consecutive frames using the first reconstructed frame as the previous good or reconstructed frame.

14. The method of claim 1, further comprising generating a final signal using the reconstructed frame, wherein the final signal is configured for presentation on a transducer.

15. The method of claim 14, further comprising presenting the final signal with the transducer.

16. A method for reconstruction of lost frames in conjunction with decoding a plurality of frames, comprising:

receiving a plurality of frames including a lost frame;

analyzing a previous good or reconstructed frame to determine a category for the lost frame;

associating a percentage $P_i$ with the determined category for the lost frame;

zeroing out a top $P_i$ percent magnitude samples in an excitation of the previous good or reconstructed frame to produce a reconstruction excitation; and applying the reconstruction to one or more linear prediction coefficients for the previous good or reconstructed frame to generate a reconstructed frame.

17. A method for reconstruction of lost frames in conjunction with encoding a plurality of frames, comprising:

generating a plurality of frames including a lost frame;

analyzing a previous good or reconstructed frame to determine a category for the lost frame;

associating a percentage $P_i$ with the determined category for the lost frame;

zeroing out a top $P_i$ percent magnitude samples in an excitation of the previous good or reconstructed frame to produce a reconstruction excitation; and applying the reconstruction to one or more linear prediction coefficients for the previous good or reconstructed frame to generate a reconstructed frame.

18. An apparatus for reconstruction of lost frames, comprising:

a processor module having a processor with one or more registers;

a memory operably coupled to the processor; and a set of processor executable instructions adapted for execution by the processor, the processor executable instructions including:

one or more instructions that when executed on the processor analyze a previous good or reconstructed frame to determine a category for the lost frame;

one or more instructions that when executed on the processor associate a percentage $P_i$ with the category determined for the lost frame;

one or more instructions that when executed on the processor zero out a top $P_i$ percent magnitude samples in an excitation of the previous good or reconstructed frame to produce a reconstruction excitation; and one or more instructions that when executed on the processor apply the reconstruction excitation to linear prediction coefficients for the previous good or reconstructed frame to generate a reconstructed frame.

19. A non-transitory computer readable medium encoded with a program for implementing a method for reconstruction of lost frames, the method comprising:

analyzing a previous good or reconstructed frame to determine a category for the lost frame;

associating a percentage $P_i$ with the determined category for the lost frame;

zeroing out a top $P_i$ percent magnitude samples in an excitation of the previous good or reconstructed frame to produce a reconstruction excitation; and applying the reconstruction excitation to one or more linear prediction coefficients for the previous good or reconstructed frame to generate a reconstructed frame.

* * * * *